US012044096B2

(12) United States Patent
Ely

(10) Patent No.: US 12,044,096 B2
(45) Date of Patent: Jul. 23, 2024

(54) METHOD FOR PLUGGING A WELLBORE ALLOWING FOR EFFICIENT RE-STIMULATION

(71) Applicant: Ely and Associates, LLC, Houston, TX (US)

(72) Inventor: John W. Ely, Montgomery, TX (US)

(73) Assignee: Ely and Associates, LLC, Houston, TX (US)

( * ) Notice: Subject to any disclaimer, the term of this patent is extended or adjusted under 35 U.S.C. 154(b) by 0 days.

(21) Appl. No.: 16/953,127

(22) Filed: Nov. 19, 2020

(65) Prior Publication Data

US 2022/0154546 A1 May 19, 2022

(51) Int. Cl.

| | |
|---|---|
| ***E21B 33/13*** | (2006.01) |
| ***E21B 33/068*** | (2006.01) |
| ***E21B 37/02*** | (2006.01) |
| ***E21B 47/06*** | (2012.01) |

(52) U.S. Cl.

CPC ..... *E21B 33/13* (2013.01); *E21B 33/068* (2013.01); *E21B 37/02* (2013.01); *E21B 47/06* (2013.01); *E21B 2200/01* (2020.05)

(58) Field of Classification Search

CPC ..... E21B 33/13; E21B 33/068; E21B 37/02; E21B 47/06; E21B 2200/01

See application file for complete search history.

(56) References Cited

U.S. PATENT DOCUMENTS

| | | | | |
|---|---|---|---|---|
| 2009/0255674 | A1* | 10/2009 | Boney | E21B 33/138 166/284 |
| 2017/0114624 | A1* | 4/2017 | Ely | E21B 33/13 |
| 2017/0335651 | A1* | 11/2017 | Watson | E21B 43/114 |
| 2018/0245439 | A1* | 8/2018 | Entchev | E21B 43/26 |

* cited by examiner

*Primary Examiner* — Caroline N Butcher
(74) *Attorney, Agent, or Firm* — Tumey L.L.P.

(57) ABSTRACT

A method for permanently sealing or bridging perforations disposed in a wellbore that was previously subjected to various completion operations and comprises a plurality of perforated sections comprising a plurality of perforations. In one embodiment, the method comprises configuring a ball injector or multiple ball injectors at the surface of the wellbore, pumping non-degradable perforation ball sealers into the perforated sections via the ball injector, wherein the non-degradable perforation ball sealers permanently seal all perforated sections in the wellbore, and monitoring pressure within the wellbore during operation to determine a successful seal of all the perforated sections.

11 Claims, 3 Drawing Sheets

METHOD FOR PLUGGING A WELLBORE ALLOWING FOR EFFICIENT RE-STIMULATION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Invention

The present invention relates to the field of wellbore re-stimulation (i.e., refracturing or refracing). More particularly, the present invention relates to a method for plugging wellbore perforations formed during a previous well stimulation process, which allows for new wellbore perforations to be formed and subsequent wellbore stimulation.

Background of the Invention

Wellbore re-stimulation is an oil and gas industry practice of revitalizing older wells which have been fracked in the past, but are producing low yields or have stopped producing altogether. The industry often turns to wellbore re-stimulation to correct assumptions made in early frac job designs and reattempting frac jobs that were initially poorly executed. However, in order for wellbore re-stimulation to be considered a repeatable and viable process, the resulting outcome often must be economically successful.

Industry methods for re-stimulating an oil and gas well are varied and have been confronted with many challenges unique to their applications. One of the biggest challenges associated with successful wellbore re-stimulation is effectively sealing off all the long, perforated sections of the wellbore such that stimulation treatments may be delivered. Current attempts to completely seal off a previously stimulated wellbore have proven to be unreliable, unpredictable, ineffective, inefficient, and economically unjustifiable. For instance, a method directed toward the installation of secondary tubing in a wellbore is typically costly and may reduce the inner diameter of the wellbore, limiting recompletion options. Additionally, a method directed toward the pumping of temporary diverting agents may only seal certain perforated sections in a wellbore for brief periods of time, not permanently, and therefore may not allow for complete and permanent sealing of the wellbore.

Consequently, there is a need in the art for an economically justifiable method that completely and permanently plugs or seals existing perforations in a re-stimulation candidate well, thereby resulting in a perforation-free wellbore that may be perforated and re-stimulated at an operator's discretion.

BRIEF SUMMARY OF SOME OF THE PREFERRED EMBODIMENTS

These and other needs in the art are addressed in one embodiment by a method for sealing a previously stimulated wellbore, wherein the wellbore comprises a plurality of perforated sections comprising a plurality of perforations, comprising configuring a ball injector or multiple ball injectors at the surface of the wellbore, pumping non-degradable perforation ball sealers into the perforated sections via the ball injector or ball injectors, wherein the non-degradable perforation ball sealers permanently seal all perforated sections in the wellbore, and monitoring pressure within the wellbore during operation to determine a successful seal of all the perforated sections.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
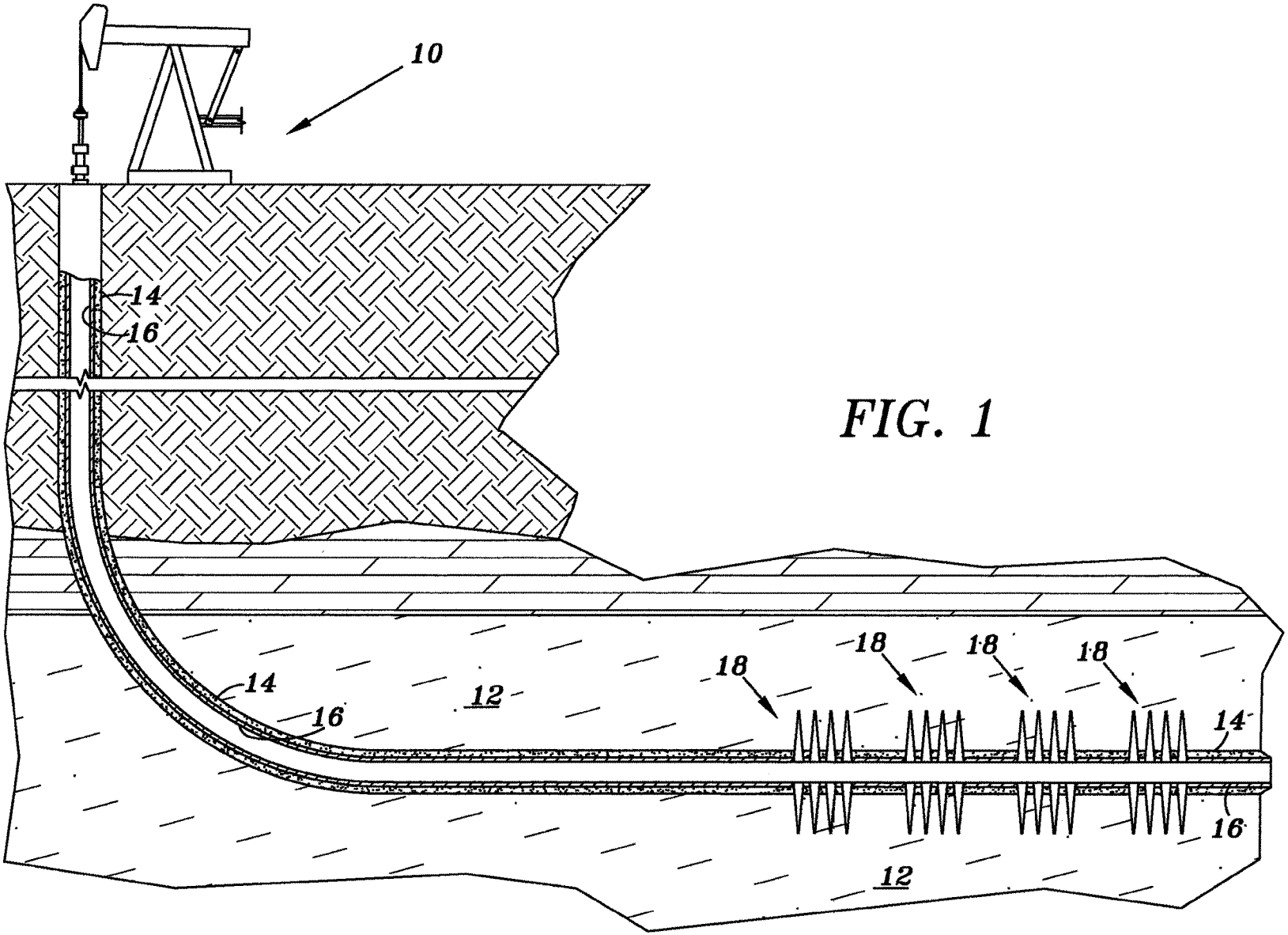
FIG. 1 illustrates a cross-sectional view of a well drilled and completed through a reservoir comprising a plurality of perforated sections in accordance with an embodiment of the present invention.

FIG. 1 illustrates a wellbore 10 that has been drilled through a reservoir 12. The wellbore 10 may comprise casing 16 and cement 14 within the annulus. Although illustrated horizontally, in embodiments, wellbore 10 may be a vertically or horizontally drilled well that was previously subjected to various completion operations, either cased-hole or open-hole operations. Further, wellbore 10 may be any suitable length or depth. The various completion operations may include, without limitation, casing, cementing, perforating, gravel packing, or other suitable completion methods. In embodiments, wellbore 10 may be a re-stimulation candidate well, or a well that has been established, through evaluation and analysis, as a suitable well for possible re-stimulation. Techniques for determining a re-stimulation candidate well may be any suitable technique, that may include, without limitation, older unconventionally drilled wells that have previously been hydraulically fractured.

Figure 2:
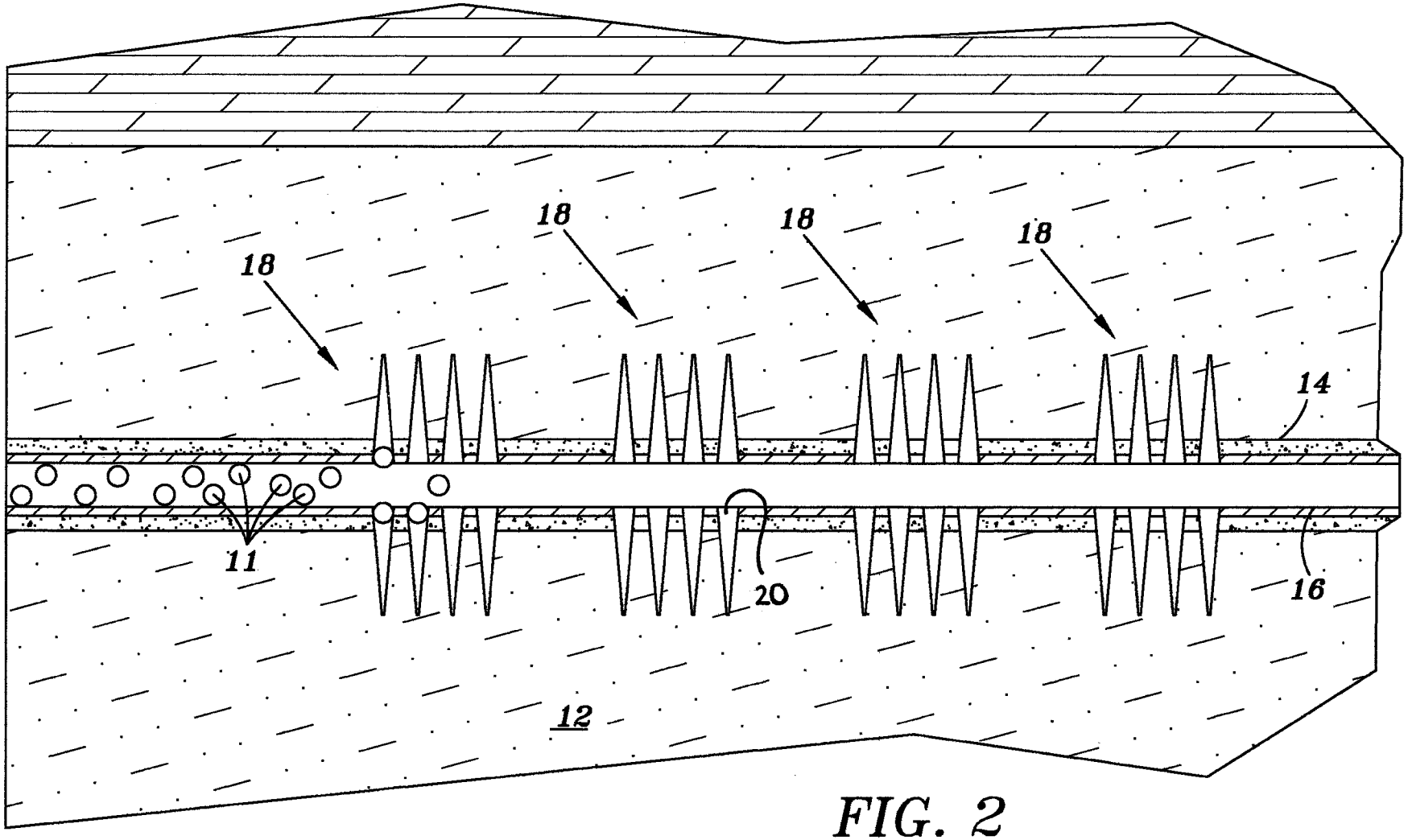
FIG. 2 illustrates the plurality of perforated sections in the well of FIG. 1 during deployment of non-degradable ball sealers in accordance with an embodiment of the present invention.

In embodiments, a deployment tool may be utilized at the wellhead of wellbore 10 to effectively and efficiently deploy bridging material to perforated sections 18 disposed in wellbore 10. FIG. 2 illustrates a downhole portion of wellbore 10 during the deployment process of a bridging material 11. Bridging material 11 may comprise any bridging material capable of permanently sealing existing perforations 20 and corresponding fractures in wellbore 10. In embodiments, bridging material 11 may be, without limitation, perforation ball sealers. Bridging material 11 may comprise any perforation ball sealers suitable for sealing perforations 20. In embodiments, the perforation ball sealers may be solid, buoyant, deformable, non-degradable, or any combinations thereof. In some embodiments, the buoyancy may allow the perforation ball sealers to flow through wellbore 10 toward perforated sections 18 via a suitable pressurized fluid, the deformability may allow the perforation ball sealers to create a tight seal within perforations 20 of wellbore 10, and the non-degradability may allow for the tight seal created in perforations 20 of wellbore 10 to remain sufficiently permanent through various re-completion operations that may occur. In embodiments, the perforation ball sealers disposed in wellbore 10 may vary in shape and size. For example, the perforation ball sealers may be spherically shaped and have a diameter measurement ranging from about 0.5 inches to about 1.5 inches. Further, the perforation ball sealers may be capable of withstanding the high pressures and high temperatures that occur within wellbore 10. For example, the perforation ball sealers may withstand pressures up to 10,000 psi and temperatures up to 400° F.

Any deployment tool suitable for injecting bridging material 11 may be used. In embodiments, the deployment tool may be a ball injector, ball gun, or ball sealer tool. Further, in some embodiments, the deployment tool may consist of multiple ball injectors configured in-line and disposed at the surface of the wellbore. The ball injector or ball injectors may carry any suitable number of perforation ball sealers. In some embodiments, each ball injector may carry up to about 250 perforation ball sealers. In embodiments, the deployment tool may be installed in any suitable manner. In some embodiments, the deployment tool may be installed in a high-pressure line at the wellhead, between a pressure pump and wellbore 10, thus, without limitation, allowing for the perforation ball sealers to be pumped into wellbore 10 along with the pressurized fluid. It is to be understood that any suitable pressurized fluid may be used (e.g. water, fracturing fluid, or acidizing fluid). The perforation ball sealers may be pumped into wellbore 10 at any desired rate. In some embodiments, the rate may be between about 4 barrels/min and about 100 barrels/min, or alternatively between about 30 barrels/min and about 100 barrels/minute, or further alternatively between about 60 barrels/min and about 70 barrels/minute. During deployment, the perforation ball sealers typically follow the path of least resistance and as a result may gradually plug perforations 20 in wellbore 10. In embodiments, the perforation ball sealers may be pumped into wellbore 10 until substantially all perforations 20 of perforated sections 18 are successfully plugged.

In embodiments, perforations 20 may be present downhole at any suitable depth and may lead to fractures disposed in reservoir 12 that may be present from previous well stimulation. Although not fully illustrated, wellbore 10 may comprise any number of perforated sections 18, measuring at any suitable length, and comprising any suitable number of perforations 20. In some embodiments, wellbore 10 may comprise perforated section 18 measuring up to 5 miles long and a total number of perforations 20 numbering between about 1,000 and about 4,000, or alternatively between about 1,000 and about 2,000.

In embodiments, the pressure within wellbore 10 may be monitored throughout the deployment of bridging material 11. During deployment, a particular pressure signature within wellbore 10 may indicate that substantially all perforations 20 have been successfully sealed. In embodiments, this particular pressure signature may vary between wells depending on the well's burst pressure. In an embodiment, the pressure signature indicating successful sealing of wellbore 10 may be between about 25% and about 80% of the well's burst pressure, or alternatively between about 30% and about 80%, or further alternatively between about 40% and about 80%, or further alternatively between about 60% and about 80%. In some embodiments, the pressure signature indicating successful sealing of wellbore 10 may be between about 30% and about 40% of the well's burst pressure. Without limitation, once this particular pressure signature is achieved, an operator's ability to deploy more bridging material 11 may be significantly restricted. In an embodiment, once the desired particular pressure signature is achieved, the deployment of bridging material 11 is halted.

Figure 3:
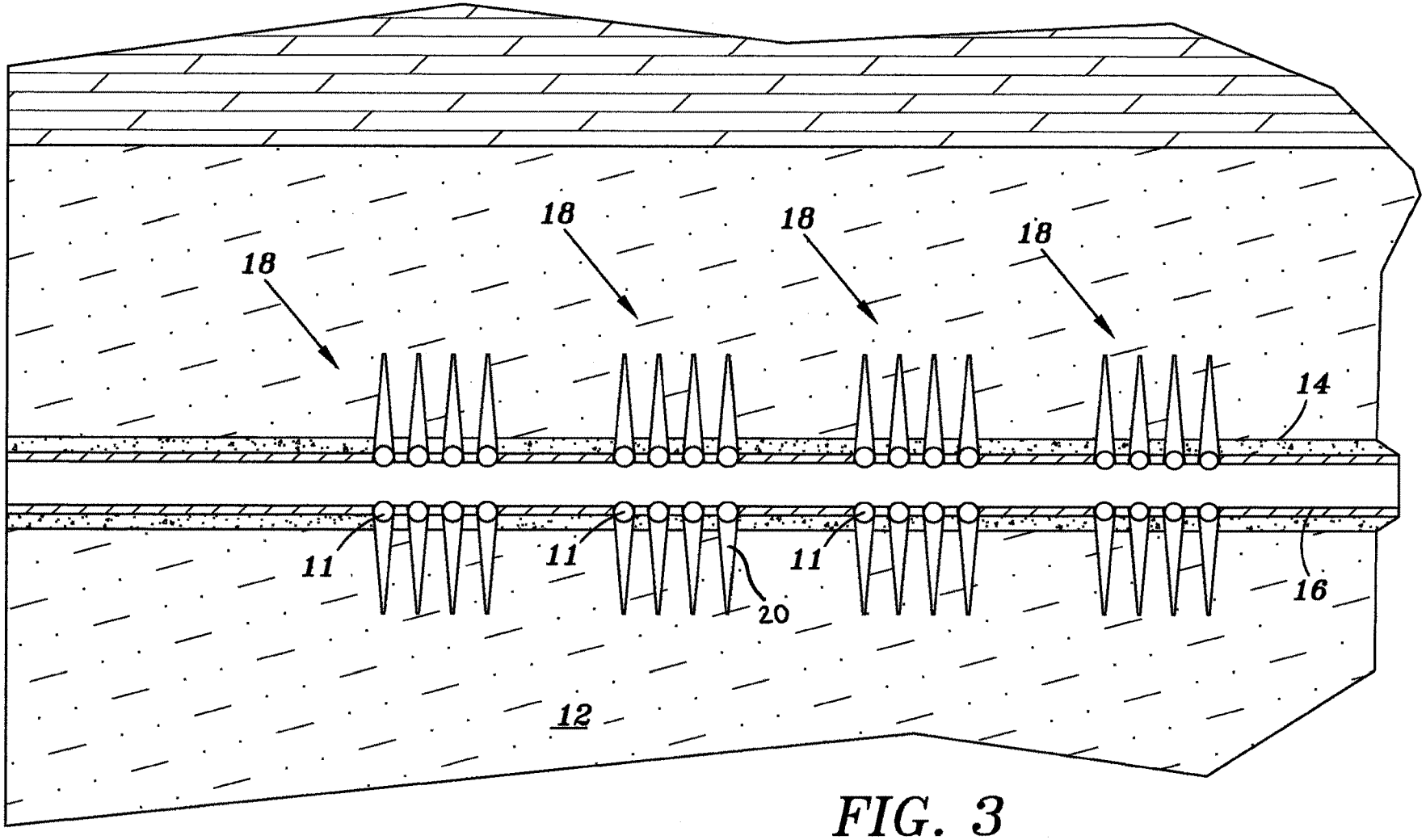
FIG. 3 illustrates the plurality of perforated sections in the well of FIG. 1 completely and permanently sealed with the non-degradable ball sealers in accordance with an embodiment of the present invention.

FIG. 3 illustrates at least a portion of wellbore 10 in which substantially all perforations 20 have been successfully and permanently sealed by bridging material 11. As such, upon successful testing and verification, sealed wellbore 10 may allow for the various completion operations to once again be performed on the well. However, in some embodiments, successful testing and verification may not be achieved until wellbore 10 has undergone additional procedures ensuring a complete and successful seal.

In some embodiments, a particulate bridging material may be injected following the injection of bridging material 11. The particulate bridging material may be any suitable particulate material capable of filling any gaps present between bridging material 11, thus enforcing the seal created by bridging material 11. In embodiments, the particulate bridging material may be any substantially non-degradable material such as, without limitation, sand, gravel, cementitious material, the like, or any combinations thereof. Any suitable cementitious material may be used such as, without limitation, hydraulically-set cementitious material. In embodiments, the particulate bridging material may be a buoyant material and, in some embodiments, the particulate bridging material may be a fine material.

In some embodiments, a packer may be run and set at the bottom of wellbore 10 in order to facilitate the sealing process. The packer may be disposed at any point during the sealing process such as before or after bridging material 11 has been injected, or before or after the particulate bridging material has been injected.

In addition to these procedures, some embodiments of wellbore 10 having been successfully sealed may be cleaned out before completion operations may commence. In some embodiments, the sealing process may result in bridging material 11 and/or the particulate bridging material obstructing the inside of wellbore 10. As such, a drill string, scraper, or the like, may be run into wellbore 10 to clear out any obstructions. Once substantially clear, wellbore 10 may once again allow for various completion operations to be performed on the well.

Although the present invention and its advantages have been described in detail, it should be understood that various changes, substitutions and alterations may be made herein without departing from the spirit and scope of the invention as defined by the appended claims.

What is claimed is:

1. A method of providing a perforation-free wellbore, wherein the wellbore comprises a plurality of perforated sections comprising a plurality of perforations, comprising:

(A) configuring a deployment tool at a wellhead of the wellbore, wherein the deployment tool comprises a plurality of ball injectors configured in-line;

(B) pumping solid, buoyant, deformable, non-degradable perforation ball sealers into the plurality of perforated sections via the plurality of ball injectors, wherein the non-degradable perforation ball sealers permanently seal substantially all perforated sections in the wellbore, and further wherein the non-degradable perforation ball sealers are capable of withstanding pressures up to 10,000 psi and temperatures up to 400° F.;

(C) monitoring pressure within the wellbore during the pumping to determine a successful permanent seal of substantially all the perforated sections;

(D) halting the pumping once the desired particular pressure signature is achieved;

(E) injecting a particulate bridging material into the wellbore, wherein the particulate bridging material comprises hydraulically-set cementitious material;

(F) running and setting a packer at the bottom of the wellbore, wherein the packer facilitates the sealing process;

(G) testing and verifying the successful permanent seals of substantially all of the perforated sections;

(H) providing a perforation-free wellbore following determination of the successful permanent seal of substantially all of the perforations; and (I) clearing the wellbore of any obstructing non-degradable perforation ball sealers.

2. The method of claim 1, wherein at least one of the plurality of perforated sections measures up to 5 miles in length.

3. The method of claim 1, wherein the wellbore comprises between about 1,000 and about 4,000 total perforations.

4. The method of claim 1, wherein the deployment tool is installed in a high-pressure line at the wellhead, between a pressure pump and the wellbore.

5. The method of claim 1, wherein the non-degradable perforation ball sealers are pumped in the wellbore at a rate between about 4 barrels/min and about 100 barrels/min.

6. The method of claim 1, wherein the non-degradable perforation ball sealers plug the perforations of the wellbore by flowing in a path of least resistance.

7. The method of claim 1, wherein the particular pressure signature is any signature up to about 80% of the wellbore's burst pressure.

8. The method of claim 1, wherein the non-degradable perforation ball sealers have a diameter measuring between about 0.5 inches and about 1.5 inches.

9. The method of claim 1, wherein the particulate material fills gaps present in the non-degradable perforation ball sealers.

10. The method of claim 1, wherein clearing the wellbore is performed with a drill string.

11. The method of claim 1, wherein clearing the wellbore is performed with a scraper.

* * * * *